US009093771B2

(12) United States Patent
Lee et al.

(10) Patent No.: US 9,093,771 B2
(45) Date of Patent: Jul. 28, 2015

(54) SURFACE MOUNT CONNECTOR

(71) Applicant: Advanced Connectek Inc., New Taipei (TW)

(72) Inventors: Kou-Ching Lee, New Taipei (TW); Jian-Li Guan, New Taipei (TW); Ya-Ping Liang, New Taipei (TW); Yao-Te Wang, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/270,918

(22) Filed: May 6, 2014

(65) Prior Publication Data

US 2014/0242850 A1 Aug. 28, 2014

Related U.S. Application Data

(63) Continuation-in-part of application No. 13/484,122, filed on May 30, 2012, now abandoned.

(30) Foreign Application Priority Data

Dec. 9, 2011 (CN) ..... 2011 2 0509767 U

(51) Int. Cl.

| | |
|---|---|
| ***H01R 24/00*** | (2011.01) |
| ***H01R 13/426*** | (2006.01) |
| ***H01R 9/24*** | (2006.01) |
| *H01R 12/58* | (2011.01) |

(52) U.S. Cl.

CPC ..... *H01R 13/426* (2013.01); *H01R 9/24* (2013.01); *H01R 12/585* (2013.01)

(58) Field of Classification Search

USPC ..... 439/79, 660, 607.07, 607.11, 701
IPC ..... H01R 23/7073,23/6873, 23/688, 13/658, H01R 13/65807, 13/414, 13/506
See application file for complete search history.

(56) References Cited

U.S. PATENT DOCUMENTS

| | | | | |
|---|---|---|---|---|
| 5,975,917 | A | 11/1999 | Wang et al. | |
| 6,409,543 | B1 | 6/2002 | Astbury, Jr. et al. | |
| 6,682,369 | B1 | 1/2004 | Korsunsky et al. | |
| 7,094,102 | B2 * | 8/2006 | Cohen et al. | 439/607.08 |
| 7,758,357 | B2 * | 7/2010 | Pan et al. | 439/108 |
| 7,785,152 | B2 | 8/2010 | Yi et al. | |
| 8,182,289 | B2 | 5/2012 | Stokoe et al. | |

* cited by examiner

*Primary Examiner* — Hien Vu
(74) *Attorney, Agent, or Firm* — Rabin & Berdo, P.C.

(57) ABSTRACT

An electrical connector includes a housing and a terminal module assembly. The terminal module assembly includes pairs of first terminal assemblies and second terminal assemblies. Each first terminal assembly comprises a first terminal block with at least one first protrusion and at least one first recess, and a plurality of first terminals securely extending through the first terminal block. Each second terminal assembly comprises a second terminal block with at least one second protrusion and at least one second recess and a plurality of second terminals securely extending through the second terminal block. The first protrusion is engaged with the second recess, the second protrusion is engaged with the first recess, and bottom surfaces of the first and second protrusions are secured in notches on the top surface of a interior wall when the terminal module assembly is received in the housing.

13 Claims, 6 Drawing Sheets

B-B

SURFACE MOUNT CONNECTOR

CROSS-REFERENCE TO RELATED APPLICATION

This application is a continuation-in-part (CIP) of application Ser. No. 13/484,122, filed on May 30, 2012 with claiming foreign priority of CN 201120509767.9. The prior application is herewith incorporated by reference in its entirety.

BACKGROUND OF THE INVENTION

1. Field of the Invention

The invention relates to an electrical connector, and more particularly to a surface mount connector for network communication.

2. The Prior Arts

Due to the increasing demand for electronic devices to be compact and durable, manufacturers all try very hard to meet the requirements. Besides, manufacturers simultaneously improve the function and stability of the electronic devices while trying to minimize the sizes thereof.

As well known in the art, the connector is aimed to be responsible for electrical signal transmission between two electronic devices so that the function and effectiveness of the connector greatly affect the electronic system's overall performance.

Currently, as well known in the art, a surface mount connector includes a dielectric or insulating housing or receptacle and multiple terminal assemblies inserted into the dielectric or insulative housing or receptacle. Each multiple terminal assembly respectively has a plurality of terminals firmly extending through the corresponding terminal block. During manufacture, most of the terminal blocks are made by insert molding. Thereafter, terminals are extended through the terminal blocks for mating with the dielectric or insulative housing or receptacle. By way of this manufacture process, each terminal block is isolated from each other such that while the terminal blocks with a plurality of terminals firmly attached thereto are to be mated with the receptacle, loose connection among terminal blocks is a common problem, which may somehow lead to more serious problems in the future. In addition to that problem, incorrect connection with the receptacle will easily lead to faulty signal transmission or even worse, the signal will not be successfully transmitted.

SUMMARY OF THE INVENTION

The primary objective of the present invention is to provide a surface mount connector having a dielectric or insulative housing and a plurality of pairs of terminal assemblies for solving the problems such as loose connection, and misalignment of the dielectric or insulative housing and terminal assemblies. Each pairs of terminal assemblies are connected together by the configuration of protrusion and recess thereof. Moreover, the protrusions are secured in notches on top surfaces of interior walls of the dielectric or insulative housing.

Another objective of the present invention is to provide a surface mount connector which includes the notches of each elongated interior walls are configured to secure the first protrusion of the first terminal assembly and the second protrusion of the adjacent second terminal assembly so as to prevent movement of the first terminal assembly and the second terminal assembly.

Further another objective of the present invention is to provide a surface mount connector including the notches of each elongated interior wall which may facilitate alignment of and guiding the first terminal assembly and the adjacent second terminal assembly as the first protrusion and the second protrusion are inserted into the corresponding notches of each elongated interior wall when the first terminal assembly and the adjacent second terminal assembly are received in the dielectric or insulative housing.

Still another objective of the present invention is to provide a surface mount connector having through holes alternatively defined in a bottom surface of the dielectric or insulative housing so as to have a shift distance of 0.075 mm offset to an adjacent through hole to prevent interference from the adjacent terminals.

In order to accomplish the aforementioned objectives, the connector constructed in accordance with the present invention includes a dielectric or insulative housing and a terminal module assembly having a plurality of pairs of terminal assemblies. Each pairs of terminal assemblies comprises a first terminal assembly and a second terminal assembly. Each first terminal assembly comprises a plurality of first terminals extending through a first terminal block which comprises at least one first protrusion extended out from a left-hand side and at least one first recess formed on the left-hand side of the first terminal block. Each second terminal assembly comprises a plurality of second terminals extending through a second terminal block which comprises at least one second protrusion extend out from a right-hand side and at least one second recess formed on the right-hand side of the second terminal block. The first protrusion is engaged with the second recess, and the second protrusion is engaged with the first recess. The notches of an elongated interior wall of the dielectric or insulative housing are configured to engage with the first protrusion and the second protrusion when the terminal module assembly is inserted into the dielectric or insulative housing.

DETAILED DESCRIPTION OF THE PREFERRED EMBODIMENT

In order to describe details of the preferred embodiment of the present invention, description of the structure, and the application as well as the steps are made with reference to the accompanying drawings. It is learned that after the description, any variation, modification or the like to the structure and the steps of the embodiments of the preferred embodiment of the present invention is easily made available to any person skilled in the art. Thus, the following description is only for illustrative purpose only and does not, in any way, try to limit the scope of the present invention.

Figure 1:
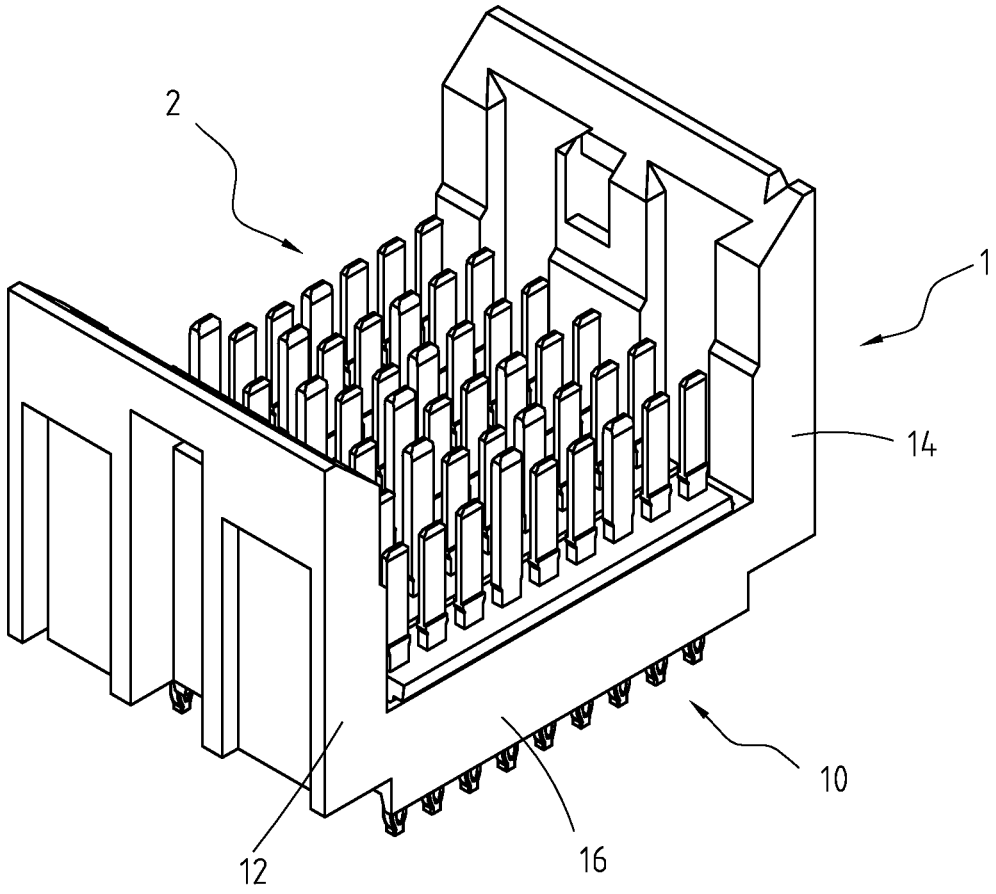
FIG. 1 is a perspective view showing the connector constructed in accordance with the present invention.
Figure 2:
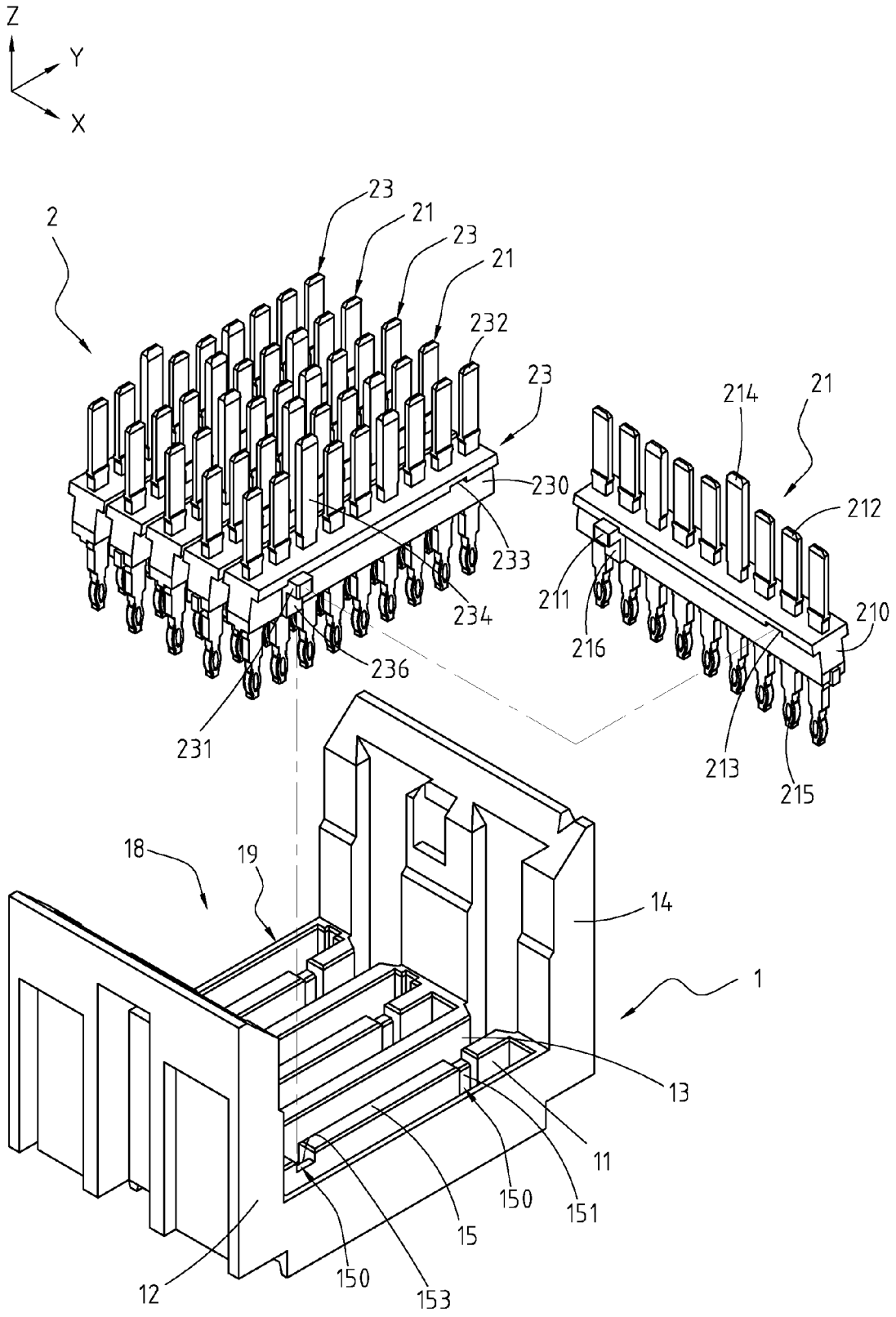
FIG. 2 is an exploded perspective view of the connector in FIG. 1.
Figure 3:
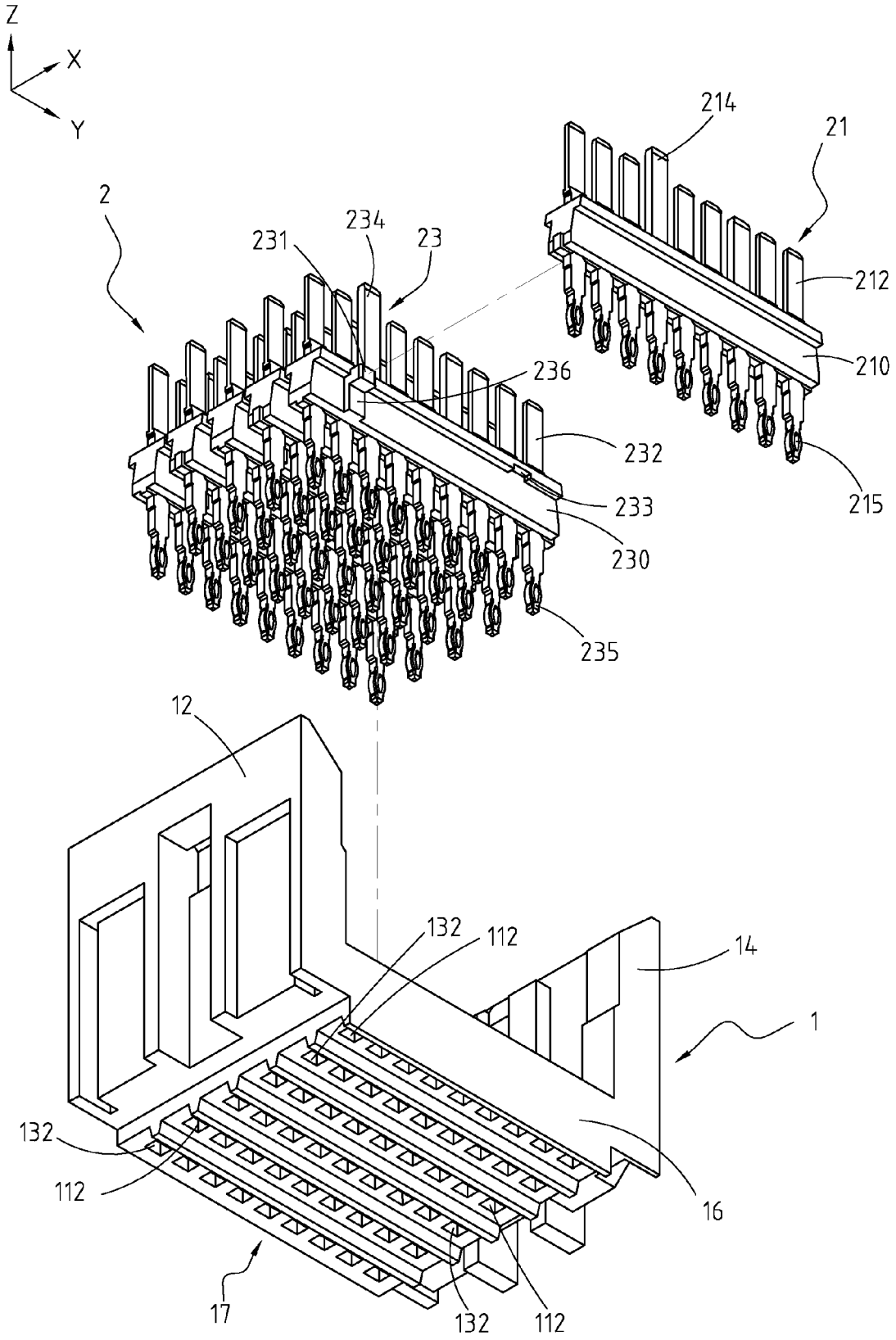
FIG. 3 is an exploded perspective view of the connector from an angle different from that of FIG. 2.

With reference to FIGS. 1, 2 and 3 of the preferred embodiment of the present invention, an electrical connector includes a dielectric or insulative housing 1 and a terminal module assembly 2, wherein the terminal module assembly 2 is inserted into or received in the dielectric or insulative housing 1. The dielectric or insulative housing 1 defines a first side wall 12, a second side wall 14, and a mounting frame 10 including a pair of side walls 16. The second side wall 14 is opposed to the first side wall 12 and spaced from the first side wall 12 along a longitudinal direction Y. The pair of side walls 16 are spaced apart along a lateral direction X that is substantially perpendicular to the longitudinal direction Y and are connected between the first side wall 12 and the second side wall 14 so as to define a terminal module receiving space 18. The first side wall 12 and the second side wall 14 extend upward from the mounting frame 10 and the side walls 16 along a vertical direction Z that is substantially perpendicular to the longitudinal direction Y and the lateral direction X. In accordance with the embodiment, the longitudinal direction Y and the lateral direction X are oriented horizontally and the direction Z is oriented vertically. Thus, the actual orientation of the electrical connector may vary during use.

The mounting frame 10 may define a mounting surface 17 disposed proximately to the bottom surface of the mounting frame 10 and a mating surface 19 disposed proximately to the top surface of the mounting frame 10. The electrical connector is configured to be mounted to a complementary electrical component, such as a substrate or a print circuit board, at the mounting surface 17, and is mated with a complementary electrical connector at the mating interface 19. Thus, when mounting the dielectric or insulative housing 1 to a complementary electrical component, such as a substrate or a print circuit board, at the mounting surface 17, for example, the mounting surface 17 may abut a surface of a substrate or a print circuit board.

The mounting frame 10 further includes a plurality of first elongated receiving slots 11 and a plurality of second elongated receiving slots 13. Each of the first elongated receiving slots 11 and the second elongated receiving slots 13 may be aligned parallel to each other and to the side walls 16 along the longitudinal direction Y. The first elongated receiving slots 11 and the second elongated receiving slots 13 are spaced apart from each other along the lateral direction X. The mounting frame 10 additionally includes a plurality of interior walls 15 disposed between the first elongated receiving slots 11 and the second elongated receiving slots 13. Each of the first elongated receiving slots 11 and the second elongated receiving slots 13 may extend along the mounting frame 10 between the first side wall 12 and the second side wall 14. Each of the first elongated receiving slots 11 and the second elongated receiving slots 13 are open at the top surface of the mounting frame 10. In other words, each of the first elongated receiving slots 11 and the second elongated receiving slots 13 are open proximately at the mating interface 19. Each of the first elongated receiving slots 11 and the second elongated receiving slots 13 may extend through the mounting frame 10 from the top surface thereof to the proximate bottom surface thereof. The mounting frame 10 additionally includes a plurality of first through holes 112 and a plurality of second through holes 132 are formed through the bottom of the mounting frame 10 which respectively communicate with the first elongated receiving slots 11 and the second elongated receiving slots 13. The first through holes 112 and the second through holes 132 are spaced apart from each other along the longitudinal direction Y and the lateral direction X so as to correspond y to an array in position.

The terminal module assembly 2 includes a plurality of first terminal assemblies 21 and a plurality of second terminal assemblies 23, wherein each first terminal assembly 21 and the corresponding adjacent second terminal assembly 23 are grouped as a pair of terminal assembly. Each first receiving slot 11 may be adapted to receive a respective first terminal assembly 21. Each second receiving slot 13 may be adapted to receive a respective second terminal assembly 23. As shown, each first terminal assembly 21 includes a first terminal block 210 and a plurality of first terminals 212, 214 extending through the first terminal block 210 along the vertical Z direction. The first terminal block 210 is typically made from an insulating material. Each first terminal assembly 21 further includes a first protrusion 211 extended out from a left-hand side of first terminal block 210 and a first recess 213 formed on the left-hand side of first terminal block 210, wherein the first protrusion 211 is closest to the second side wall 14 and is spaced apart from the first recess 213 along the longitudinal direction Y. Each second terminal assembly 23 includes a second terminal block 230 and a plurality of second terminals 232, 234 extending through the second terminal block 230. The second terminal block 230 is also typically made from an insulating material. Each second terminal assembly 23 further includes a second protrusion 231 extend out from a right-hand side of second terminal block 230 and a second recess 233 formed on the right-hand side of second terminal block 230, wherein the second recess 233 is closest to the second side wall 14 and is spaced apart from the second protrusion 231 along the longitudinal direction Y.

The first protrusion 211 of the first terminal assembly 21 and the second recess 233 of the adjacent second terminal assembly 23 may be shaped into complementary forms such that the first protrusion 211 of the first terminal assembly 21 is configured to engage with the corresponding second recess 233 of the adjacent second terminal assembly 23. The first recess 213 of the first terminal assembly 21 and the second protrusion 231 of the adjacent second terminal assembly 23 may be shaped into complementary forms such that the first recess 213 of the first terminal assembly 21 is configured to engage with the corresponding the second protrusion 231 of the adjacent second terminal assembly 23. Each of elongated interior walls 15 further includes two notches 150 formed on the top surface thereof. The notches 150 of each elongated interior wall 15 are configured to secure the first protrusion 211 of the first terminal assembly 21 and the second protrusion 231 of the adjacent second terminal assembly 23 when the first terminal assembly 21 engaged with the corresponding adjacent second terminal assembly 23 together are inserted into the corresponding first receiving slot 11 and the second receiving slot 13 respectively. The bottom surface of the first protrusion 211 and the bottom surface of the second protrusion 231 may abut the top surfaces of two notches 150 respectively. The notches 150 of each elongated interior wall 15 are configured to secure the first protrusion 211 of the first terminal assembly 21 and the second protrusion 231 of the adjacent second terminal assembly 23 so as to prevent movement of the first terminal assembly 21 and the second terminal assembly 23. The notches of each elongated interior wall 15 may facilitate alignment of and guiding the first terminal assembly 21 and the adjacent second terminal assembly 23 as the first protrusion 211 and the second protrusion 231 are inserted into the corresponding notches of each elongated interior wall 15 when the first terminal assembly 21 and the adjacent second terminal assembly 23 are received by dielectric or insulative housing 1.

The mounting ends 215 of the first terminal assembly 21 and the mounting ends 235 of the second terminal assembly 23 are inserted into a plurality of first through holes 112 and a plurality of second through holes 132 respectively such that the mounting ends 215 and the mounting ends 235 are spaced apart from each other along the longitudinal direction Y and the lateral direction X so as to correspond to an array in position when the first terminal assembly 21 engaged with the corresponding adjacent second terminal assembly 23 together are inserted into the corresponding first receiving slot 11 and the second receiving slot 13 respectively. Thus the first terminal assembly 21 engaged with the corresponding adjacent second terminal assembly 23 together are received into the dielectric or insulative housing 1.

Figure 4:
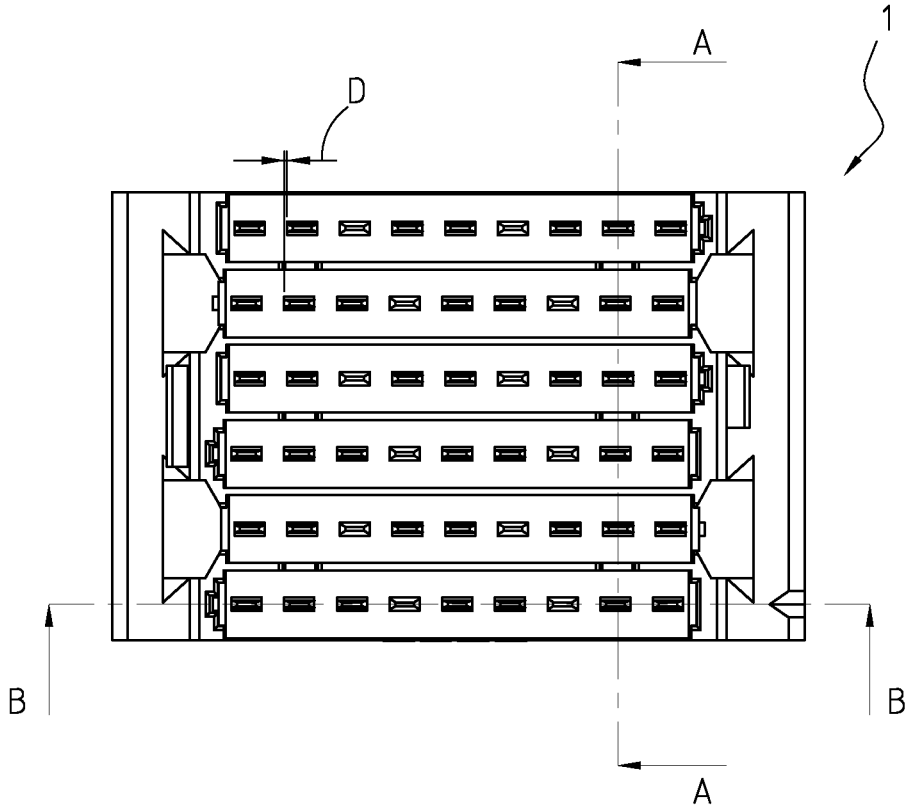
FIG. 4 is a plan view showing the top side of the dielectric or insulative housing of the connector of the present invention.
Figure 5:
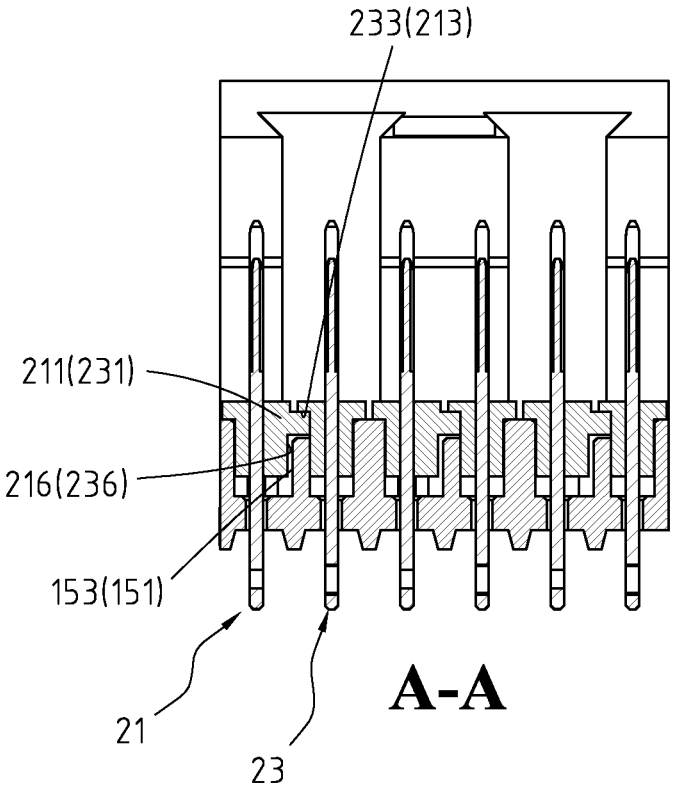
FIG. 5 is a cross-section view showing A-A cross-section of the connector of the present invention.

Referring to FIGS. 2 to 4, the first terminal block 210 further includes a first bump 216 formed thereon. The first bump 216 is connected to and extended downwardly from the bottom surface of the first protrusion 211, and the first bump 216 is perpendicular to the first protrusion 211. The thickness of the first bump 216 along the lateral direction X can be less than that of the first protrusion 211. The thickness of the first bump 216 along the longitudinal direction Y can be equal to that of the first protrusion 211. The second terminal block 230 further includes a second bump 236 formed thereon. The second bump 236 is connected to and extended downwardly from the bottom surface of the second protrusion 231, and the second bump 236 is perpendicular to the second protrusion 231. A first concave 151 is cut out by vertically extending from the notch 150 in a side of the elongated interior wall 15 and a second concave 153 is cut out by vertically extending from another notch 150 in an opposed side of the elongated interior wall 15. The thicknesses of the first concave 151 along the lateral direction X and the longitudinal direction Y are equal to those of the first bump 216. The thicknesses of the second concave 153 along the lateral direction X and the longitudinal direction Y are equal to those of the second bump 236. Consequently, the first concave 151 and the second concave 153 are configured to receive the first bump 216 and the second bump 236 respectively. By the engagement of the first protrusion 211 and the second recess 233, the second protrusion 231 and the first recess 213, the first protrusion 211, the second protrusion 231 and the notch 150, the first bump 216 and the first concave 151, and the second bump 236 and the second concave 153, the terminal module assembly can be secured to the dielectric or insulative housing 1 in three dimension.

Furthermore, because all pairs of adjacent first terminal assembly 21 and the second terminal assembly 23 are engaged with each other, problems such as loose connection, misalignment with the dielectric or insulative housing 1 are obviated. As described earlier, the first terminals 212, 214 are arranged in a column, and the second terminals 232, 234 are also arranged in another column Thus, the first terminals 212, 214 and the second terminals 232, 234 are arranged to an array when all pairs of terminal assemblies are inserted into the first through holes 112 and the second through holes 132, respectively. Regarding the terminals, the first through holes 112 are arranged in the first elongated receiving slots 11 along a column longitudinal direction Y and the second through holes 132 are arranged in the second elongated receiving slots 13 along a column longitudinal direction Y. As a result, the through holes 112 and 132 are formed to an array corresponding to the array formed by the terminals. The first terminals 212 have a length of 3.79 mm, and at least one first terminal 214 with a length of 4.79 mm is provided among the first terminals 212. The second terminals 232 have a length of 3.79 mm, and at least one first terminal 234 with a length of 4.79 mm is provided among the second terminals 232.

Figure 6:
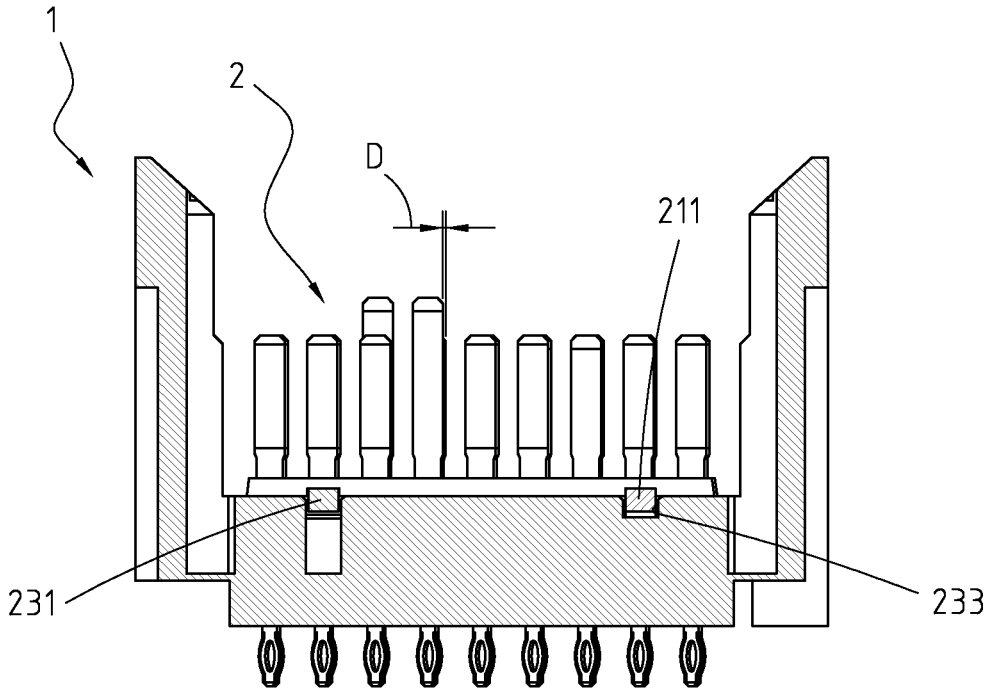
FIG. 6 is a cross-section view showing B-B cross-section of the connector of the present invention.

With reference to FIGS. 4 and 6, it is noted that a shift distance D is defined between the first through holes 112 and the adjacent second through holes 132. The shift distance D is about 0.075 mm, as shown in the FIGS. 4 and 6. The shift distance D can avoid interference from adjacent first terminals 212, 214 and the second terminals 232, 234.

While the invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An electrical connector comprising:

a plurality of pairs of terminal assemblies, each pair of terminal assemblies comprising a first terminal assembly and a second terminal assembly adjacent to said first terminal assembly, wherein each first terminal module comprises a first terminal block and a plurality of first terminals securely extending through said first terminal block, and each second terminal assembly comprises a second terminal block and a plurality of second terminals securely extending through said second terminal block; and an insulated housing comprising a plurality of first elongated receiving slots, a plurality of second elongated receiving slots, and a plurality of elongated interior walls, wherein each of the first elongated receiving slots comprises a plurality of first through holes for positioning mounting ends of said first terminals, each of said second elongated receiving slots comprises a plurality second through holes for positioning mounting ends of said second terminals, and each of said elongated interior walls is disposed between said first elongated receiving slots and said second elongated receiving slots, wherein each first terminal block comprises at least one first protrusion, and at least one first recess formed on a side of said first terminal block, each second terminal block comprises at least one second protrusion and at least one second recess formed on a side of said second terminal block corresponding to said side of said first terminal block, and each of the elongated interior walls comprises a plurality of notches, wherein said first protrusion is engaged with said corresponding second recess, said second protrusion is engaged with said corresponding first recess, and bottom surfaces of said first protrusion and said second protrusion are secured in said corresponding notches of said elongated interior walls when said plurality of pairs of terminal assemblies are received in said corresponding plurality of first elongated receiving slots and said corresponding plurality of second elongated receiving slots respectively.

2. The electrical connector as claimed in claim 1, wherein said insulated housing defines a first side wall, a second side wall, and a mounting frame comprising a pair of side walls, said second side wall is opposed to said first side wall and spaced from said first side wall along a longitudinal direction, said pair of side walls are spaced apart along a lateral direction that is substantially perpendicular to said longitudinal direction and are connected between said first side wall and said second side wall so as to define a terminal module receiving space.

3. The electrical connector as claimed in claim 2, wherein said first side wall and said second side wall extend upward from said mounting frame and said side walls along a vertical direction that is substantially perpendicular to said longitudinal direction and said lateral direction.

4. The electrical connector as claimed in claim 3, wherein said mounting frame defines a mounting surface disposed proximately to a bottom surface of said mounting frame and a mating surface disposed proximately to a top surface of said mounting frame and said electrical connector is configured to be mounted to a complementary electrical component at said mounting surface and is mated with a complementary electrical connector at said mating interface.

5. The electrical connector as claimed in claim 4, wherein said mounting frame further comprises said plurality of first elongated receiving slots and said plurality of second elongated receiving slots, and each first receiving slot and each second receiving slot are aligned parallel to each other and to said side walls along said longitudinal direction.

6. The electrical connector as claimed in claim 5, wherein said first elongated receiving slots and said second elongated receiving slots are spaced apart from each other along said lateral direction.

7. The electrical connector as claimed in claim 6, wherein each of said first elongated receiving slots and said second elongated receiving slots extend along said mounting frame between said first side wall and said second side wall.

8. The electrical connector as claimed in claim 7, wherein each of said first elongated receiving slots and said second elongated receiving slots are open at said top surface of said mounting frame.

9. The electrical connector as claimed in claim 8, wherein said mounting frame comprises said plurality of first through holes and said plurality of second through holes formed through said bottom surface of said mounting frame which respectively communicate with said first elongated receiving slots and said second elongated receiving slots.

10. The electrical connector as claimed in claim 9, wherein said first through holes and said second through holes are spaced apart from each other along said longitudinal direction and said lateral direction so as to correspond positionally to an array.

11. The electrical connector as claimed in claim 1, wherein each first terminal block further comprises at least one first bumps connected to and extended downwardly from said bottom surface of said first protrusion, each second terminal block further comprises at least one second bumps connected to and extended downwardly from said bottom surface of said second protrusion, and each of the elongated interior walls further comprises at least one first concave formed on a side of said elongated interior walls and at least one second concave formed on an opposed side of said elongated interior walls, wherein said first concave is formed by vertically extending from one of said notches in said side of said interior wall, said second concave is formed by vertically extending from another one of said notches in an opposed side of said interior wall, and each first concave receives each first bump, and each second concave receives each second bump, respectively.

12. The electrical connector as claimed in claim 1, wherein a shift distance is defined between one of the first through holes and adjacent one of the second through holes.

13. The electrical connector as claimed in claim 12, wherein said shift distance is 0.075 mm.

* * * * *